362-112 SR
12/2/80 XR 4,236,348

United States Patent [19]

DuLac

[11] 4,236,348

[45] Dec. 2, 1980

[54] TOY SPACE GUN

[76] Inventor: Steven M. DuLac, 23138 W. LeBost Dr., Novi, Mich. 48050

[21] Appl. No.: 14,824

[22] Filed: Feb. 26, 1979

[51] Int. Cl.[3] ..... A63H 33/26

[52] U.S. Cl. ..... 46/228; 46/1 E; 273/310; 362/112

[58] Field of Search ..... 46/228, 226, 1 E; 273/101.1, 310, 311, 312; 362/109, 111, 112

[56] References Cited

U.S. PATENT DOCUMENTS

| | | | |
|---|---|---|---|
| 1,645,881 | 10/1927 | Strong | 362/111 |
| 2,588,036 | 3/1952 | O'Quinn | 362/112 X |
| 2,783,588 | 3/1957 | Charvat | 46/228 X |
| 3,294,401 | 12/1966 | Nicholas et al. | 46/228 X |

FOREIGN PATENT DOCUMENTS

| | | | |
|---|---|---|---|
| 1119563 | 6/1956 | France | 46/228 |

*Primary Examiner*—Gene Mancene
*Assistant Examiner*—Mickey Yu
*Attorney, Agent, or Firm*—Barnes, Kisselle, Raisch & Choate

[57] ABSTRACT

A toy space gun comprising a hollow chamber and an elongate hollow cylindrical barrel extending therefrom, both of opaque molded plastic construction. A strobe unit including a strobe lamp is responsive to an operator trigger for generating a high intensity light flash of short duration. The lamp is mounted at the inner barrel end by a concave reflector which cooperates with a reflective internal surface in the barrel for projecting a major portion of the light flash through the barrel in a condensed pattern.

4 Claims, 4 Drawing Figures

TOY SPACE GUN

The present invention pertains to amusement devices, and more particularly to toy ray-type space guns.

A renewed popularity of futuristic and space-related fantasies in movies, television and comic books has created an increased demand for toy light guns of the type which simulate the ray- or laser-type weapons used by the fantasy heroes. Of particular interest is the "blaster" type gun characterized by a relatively short burst of intense light. This increased market demand is not satisfied by the relatively unsophisticated flashlight-type ray guns characteristic of the prior art.

Accordingly, a general object of the present invention is to provide a toy gun which recreates the "blaster" action of the weapons seen in movie and television fantasies. Specifically, it is an object of the invention to provide a toy gun of the type described which emits a high intensity light beam of short duration and projects such beam for a substantial distance, and/or which emits an audible sound related in time and duration to the pulsed light beam.

A further object of the invention is to provide a toy gun of the type described which may be economically manufactured of predominantly low cost and light weight materials such as plastic, and yet is able to withstand the rigors of child use.

The invention, together with additional objects, features and advantages thereof, will be best understood from the following description, the appended claims and the accompanying drawings in which:

Figures 1, 2:
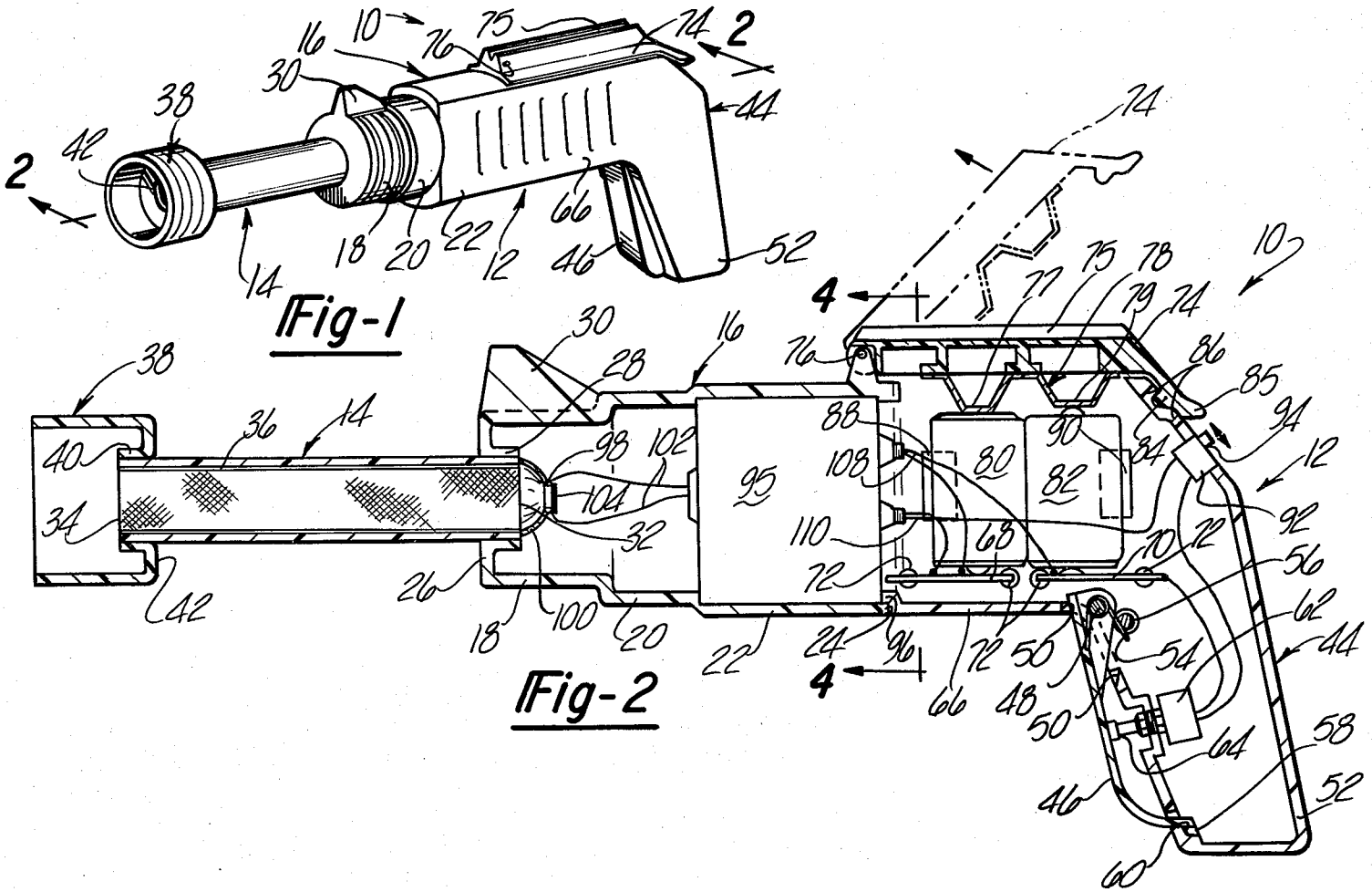
FIG. 1 is an elevational perspective view of a presently preferred embodiment of the invention.
FIG. 2 is a side sectional view taken generally along the line 2—2 in FIG. 1.

A presently preferred embodiment 10 of the space gun provided in accordance with the invention is illustrated in the drawings as comprising a two-piece body defining a hollow firing chamber 12 having an elongate hollow cylindrical barrel 14 extending axially therefrom. Firing chamber 12 includes a forward section 16 in the form of a rearwardly-opening hollow cup. Section 16 comprises coaxial cylindrical contiguous first and second wall portions 18,20 of respectively increasing diameter and a third generally rectangular wall portion 22 contiguous and coaxial with wall portion 20 and forming the open rear end or rim 24 of front section 16. The vertical transverse dimension of rectangular wall portion 22 is slightly greater than the diameter of contiguous cylindrical wall portion 20 so as to form a generally stepped wall configuration as best seen in FIG. 2. A circular center opening is formed in the closed end 26 of chamber section 16 by the inwardly projecting annular flange 28 to receive barrel 14 as will be described. A radially extending rib 30 formed externally of wall portion 18 simulates a sight bead.

Barrel 14 is received by press-fit in and/or adhered to flange 28 (FIG. 2) and projects coaxially therefrom. In accordance with an important feature of the invention, barrel 14 (and chamber 12) is constructed of opaque material such as molded plastic. A layer 36 (FIG. 2) of optically reflective material covers the cylindrical inner surface of barrel 14 and extends from inner end 32 of the barrel to the outer end 34 of the barrel. Layer 36 may comprise a prefabricated sleeve held by press-fit or chemical adhesive within barrel 14, or may comprise a film painted or coated onto the inside barrel surface. The barrel is open at both ends. An outwardly open hollow cup 38 is cocylindrical with chamber wall portion 18 and has an outwardly projecting flange 40 in its base 42 defining a central opening received by press-fit over and/or adhered to barrel end 34.

Firing chamber 12 further comprises a hollow forwardly opening inverted L-shaped handle section 44. A trigger 46 is pivotally mounted on a pin 48 (FIG. 2) internally of handle section 44 and projects therefrom through an opening 50 outwardly and downwardly adjacent the hand grip portion 52 of handle section 44. A spring 54 is coiled around pivot pin 48 and has radially extending ends which cooperate respectively with an internal boss 56 and an opposing inside surface of trigger 46 for biasing the trigger to an outer rest position best seen in FIG. 2. Outward movement of trigger 46 in the rest position is limited by a lip 58 projecting from a lower edge of the trigger and cooperating with an opposing internal shoulder or ledge 60 within the lower extremity of hand grip portion 52. An electrical switch 62 is mounted on hand grip section 52 and has a push-button actuator 64 projecting therefrom into operative engagement with the opposing inside surface of trigger 46. Thus, counterclockwise manipulation of trigger 46 in FIG. 2 against the force of spring 54 depresses actuator 64 and closes a pair of normally open contacts (not shown) in electrical switch 62.

A pair of electrically isolated coplanar flat bus bars 68,70 (FIG. 2) are rigidly and fixedly mounted on the bosses 72 projecting from a side wall of a forwardly-opening generally rectangular base portion 66 of L-shaped handle section 44. A door 74 is pivotally mounted by a pin 76 to an upper edge of forward chamber section 16 and projects rearwardly therefrom to form an upper wall for handle portion 66 in the closed position illustrated in solid lines in the drawings. An undulating electrically conductive spring contact member 78 is carried internally of door 74 and has a pair of lower flat coplanar crowns 77,79 disposed in the closed position of door 74 in respective opposition to bus bars 68,70 for holding a pair of dry cell batteries 80,82 therebetween. A lip 84 (FIG. 2) on the outwardly flared free edge 85 of door 74 is adapted to be received by releasable snap fit in an opening 86 in the opposing surface of handle section 44. Contact member 78 is preferably of resilient electrically conducted material and is slightly compressed in the locked position of door 74 such that batteries 80,82 are held firmly against axial movement by contact member 78 and bus bars 68,70. A pair of ledges 88,90 (FIG. 2) project laterally from a side wall of chamber portion 66 and are spaced from each other longitudinally of the gun to permit batteries 80,82 to be positioned therebetween and held against lateral movement. A V-shaped channel or groove 75 is formed along the upper surface of door 74 in alignment with rib 30 to operate as a gun sight.

Figure 3:
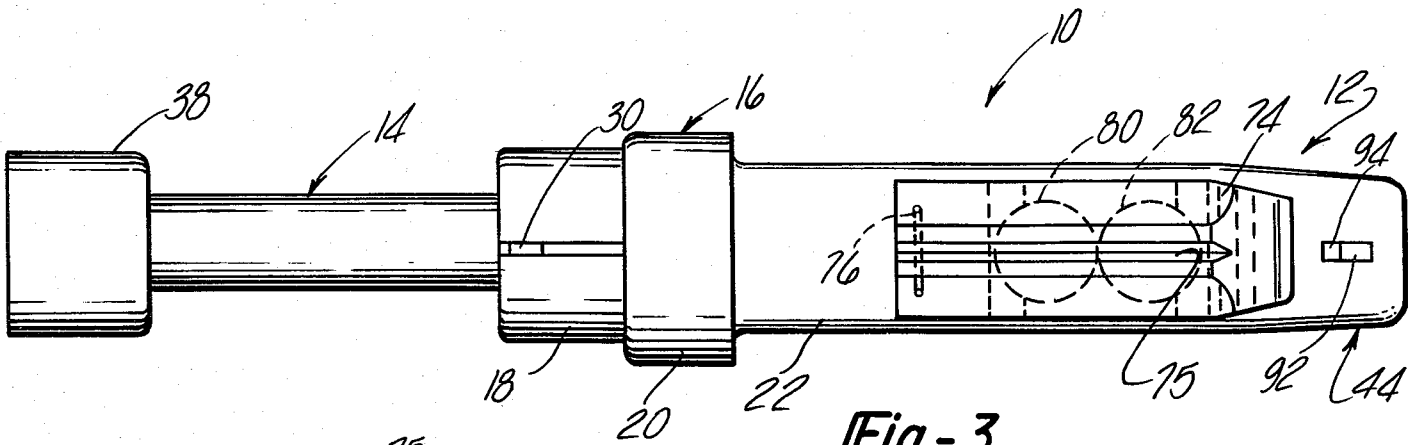
FIG. 3 is a plan view of the embodiment illustrated in FIG. 1.
Figure 4:
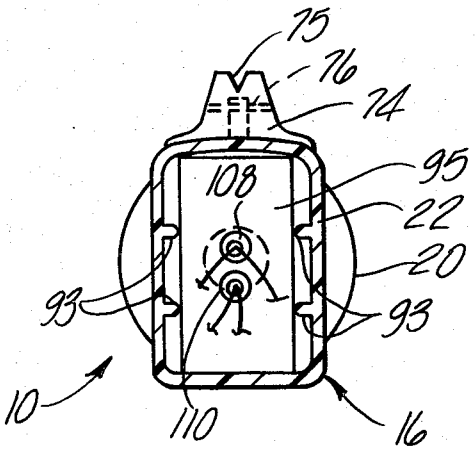
FIG. 4 is a sectional view taken along the line 4—4 in FIG. 2.

An on-off switch 92 (FIGS. 2 and 3) is mounted on a rear surface of handle section 44 beneath flared door edge 85 in the closed position of the latter, and has a slide-type actuator 94 projecting outwardly therefrom. A strobe-type flash unit generally indicated at 95 is received and held in the rectangular portion 22 of forward chamber section 16 by snug press-fit between the ribs 93 (FIG. 4) projecting inwardly from lateral chamber walls. Axially, strobe unit 95 is captured therein against the shoulder defined by contiguous cylindrical wall portion 20 by a circumferential lip 96 extending around the open end of handle section 44. A xenon incandescent lamp 98 (FIG. 2) is carried by a concave reflector 100 mounted across the inner open end 32 of barrel 14. Lamp 98 is connected by the leads 102 to strobe unit 95 and is preferably coated as at 104 on its inner surface with reflective material so as to cooperate with reflector 100 and reflective barrel layer 36 for substantially optically isolating the lamp from the remaining components in firing chamber 12, and projecting substantially the entire light generated by lamp 84 axially outwardly through barrel 14.

Strobe unit 95 may comprise any suitable camera-type flash unit for storing a charge of electrical energy from batteries 80,82 via power input leads 108 and responsive to a trigger input via leads 110 rapidly to discharge the stored energy through lamp 104. For this purpose, power leads 108 are connected directly to bus bars 68,70, and trigger leads 110 are connected to the bus bars in series with on-off switch 92 and trigger switch 62. The circuits so formed are completed through batteries 80,82 which are serially connected to each other by contact member 78. Typical flash units 95 require several seconds to store energy between firings and will not respond to a trigger signal until stored charge has reached a desired level. Also typically, flash unit 95 emits a pinging sound upon triggering which, while not loud, is contemporaneous with the light flash transmitted through barrel 14. Chamber sections 16,44, door 74, trigger 46 and cup 38, as well as barrel 14, are all preferably constructed of light weight rugged opaque plastic material.

It has been found in testing a working prototype of the invention that internally reflective barrel 14 operates substantially to condense light emitted by lamp 98 and to project such light in a condensed high intensity pattern for a substantial distance. Using a standard rechargeable camera strobe unit and a barrel of about eight inches in length and about one and one-eighth inch in diameter, the flash pattern at a distance of fifty feet at night had a condensed pattern of only a few feet in diameter.

It will be apparent from the foregoing description that the preferred embodiment of the invention described in detail in connection with the application drawings fully satisfies all of the objects and aims previously set forth. Major components may be inexpensively constructed of molded plastic or the like in any of a wide variety of ornamental configurations. The overall assembly is both light weight and rugged. The internally reflective barrel combines with the strobed lamp to yield a pleasing quasi-focused flash effect as previously described.

Although the invention has been described in connection with a preferred embodiment thereof, a number of alternatives and modifications will suggest themselves to a person skilled in the art. For example, it may be preferable in some instances to provide an optically transparent closure element in the forward end of barrel 14 for preventing accidental or intentional insertion of objects, and thereby protecting lamp 84 from damage. Such a closure may advantageously comprise a plastic lens for enhancing the beam condensing effect of the barrel. Similarly, although battery-powered operation is preferred, it is contemplated that suitable means may be provided in place of or in addition to batteries 80,82 for plugging into a utility wall outlet and thereby storing energy during periods of non-use.

Another modification which may be advantageous is some instances is to include circuitry in strobe unit 95 to flash lamp 98 at periodic intervals when trigger 28 is held in the retracted or actuated position. As a further modification, suitable means may be provided for adjusting the charge time and/or the delay time between flashes to provide either substantially continuous flashing or flashing at extended intervals when the trigger is held in the depressed position. It is believed that either of such modifications would lead to rapid battery discharge when the gun is used by the intended operator, i.e. a child, and therefore neither is preferred. However, the invention is intended to embrace the foregoing and all other alternatives, modifications and variations as fall within the spirit and broad scope of the appended claims.

The invention claimed is:

1. A toy gun comprising a hollow body of opaque construction and defining a firing chamber, an elongated hollow barrel of opaque construction extending axially from said body and having an internal end opening into said chamber, said barrel being optically transparent through its axial length and having an internal surface of optically reflective material, outwardly concave reflective means mounted within said chamber to enclose said internal end of said barrel, a lamp carried by said concave reflective means adjacent said internal barrel end such that light generated by said lamp is substantially isolated from said chamber by said reflective means and is substantially entirely projected through said barrel, a trigger mounted on said body and including operator responsive switch means extending from within said chamber, and power means disposed within said chamber and connected to said lamp and said switch means for generating light energy at said lamp for remote projection through said barrel.

2. The toy gun set forth in claim 1 wherein said power means comprises strobe means in said chamber coupled to said lamp and said switch means for generating a high intensity light flash of short duration at said lamp for remote projection through said barrel.

3. The toy gun set forth in claim 1 or 2 wherein said chamber and barrel are of opaque molded plastic construction, and wherein said reflective internal surface comprises a coating of optically reflective material.

4. The toy gun set forth in claim 1 or 2 wherein said chamber and barrel are of opaque molded plastic construction, and wherein said reflective internal surface comprises a sleeve of optically reflective material secured internally of said barrel.

* * * * *